US010118066B2

(12) United States Patent
Clerk

(10) Patent No.: US 10,118,066 B2
(45) Date of Patent: Nov. 6, 2018

(54) BARBELL PIVOT APPARATUS

(71) Applicant: Exemplar Design, LLC, Mason, OH (US)

(72) Inventor: Jason Clerk, Toronto (CA)

(73) Assignee: Exemplar Design, LLC, Mason, OH (US)

( * ) Notice: Subject to any disclaimer, the term of this patent is extended or adjusted under 35 U.S.C. 154(b) by 208 days.

(21) Appl. No.: 15/396,154

(22) Filed: Dec. 30, 2016

(65) Prior Publication Data

US 2017/0189737 A1 Jul. 6, 2017

Related U.S. Application Data

(60) Provisional application No. 62/274,234, filed on Jan. 1, 2016.

(51) Int. Cl.

| | |
|---|---|
| ***A63B 21/072*** | (2006.01) |
| ***A63B 21/08*** | (2006.01) |
| ***A63B 23/035*** | (2006.01) |
| ***A63B 21/16*** | (2006.01) |
| ***A63B 21/06*** | (2006.01) |
| ***A63B 21/00*** | (2006.01) |
| *A63B 23/12* | (2006.01) |

(52) U.S. Cl.
CPC ..... *A63B 21/08* (2013.01); *A63B 21/0617* (2015.10); *A63B 21/0724* (2013.01); *A63B 21/169* (2015.10); *A63B 21/4049* (2015.10); *A63B 23/03508* (2013.01); *A63B 23/1209* (2013.01)

(58) Field of Classification Search
CPC ..... A64B 21/0615; A64B 21/0616; A64B 21/0617; A64B 21/0724; A64B 21/08
See application file for complete search history.

(56) References Cited

U.S. PATENT DOCUMENTS 605,747 A * 6/1898 Sachs ..... A63B 21/0615 482/97

* cited by examiner

*Primary Examiner* — Rae Fischer
(74) *Attorney, Agent, or Firm* — Baker & Hostetler LLP

(57) ABSTRACT

The present disclosure is directed to facilitating angled barbell exercises. An embodiment of the present disclosure includes an apparatus for facilitating angled barbell exercises which includes a receiving surface having a substantially concave front side including a central region and a back side; and a support frame coupled to the back side of the receiving surface, the support frame including a floor support having a planar surface and a wall support having a planar surface; wherein the planar surface of the floor support is horizontal and positioned to contact a floor; and wherein the planar surface of the wall support is vertical and positioned to contact a wall that is perpendicular to the floor.

12 Claims, 4 Drawing Sheets

BARBELL PIVOT APPARATUS

BACKGROUND

Angled barbell exercises may be performed by placing one end of a barbell against a support, such as the junction of a floor and a wall, and performing various movements with the other end of the barbell. Weights may be added to increase the amount of exertion required to manipulate the barbell. Angled barbell exercises may allow an individual perform a large variety of different exercises using varying amounts of weight with little equipment required. A large range of motion may be attained with angled barbell exercises. Angled barbell exercises may be performed using any barbell and weight set and are often performed using Olympic-sized barbells.

Despite these advantages, angled barbell exercises have several disadvantages. Angled barbell exercises generally require some sort of support about which one end of the barbell may pivot. If one end of the barbell is placed at the junction between a floor and a wall, such as a corner, repeated use may result in the barbell damaging the wall or the floor. This potential for damage may reduce the attractiveness of these exercises for homeowners (despite the advantages of little required equipment and potential variety of exercises). The potential for damage is especially relevant for homeowners with baseboards along the bottom of a wall.

One solution has been to affix a tube to a wide base. A sleeve of a barbell may be inserted into the tube, which can rotate or pivot with respect to the base, which is not intended to move. These apparatus are generally made using a large amount of metal, rendering the devices expensive and heavy and disadvantageous for casual exercisers, such as individuals looking to exercise at home. Another solution is to coat a corner junction between a floor and walls with metal plating, but this expensive, permanent, and immobile, again presenting several disadvantages to individuals looking to exercise at home.

An object of the present disclosure is to address one or more of the disadvantages identified above.

SUMMARY

The present disclosure is directed to facilitating angled barbell exercises.

In an embodiment, an apparatus for facilitating angled barbell exercises includes a receiving surface having a substantially concave front side including a central region and a back side; and a support frame coupled to the back side of the receiving surface, the support frame including a floor support having a planar surface and a wall support having a planar surface; wherein the planar surface of the floor support is horizontal and positioned to contact a floor; and wherein the planar surface of the wall support is vertical and positioned to contact a wall that is perpendicular to the floor. In use, the concave front side of the receiving surface may receive one end of a barbell. The concave nature of the front side of the receiving surface may funnel the end of the barbell toward the central region and provide support for the end of the barbell to keep it in place while allowing the barbell to rotate or pivot during exercise movements.

In an embodiment, an apparatus for facilitating angled barbell exercises may be constructed primarily from a durable thermoplastic that is relatively lightweight, thus facilitating portability, and resistant to wear from a pivoting or rotating barbell. In an embodiment, an apparatus for facilitating angled barbell exercises may be constructed or formed from nylon, polyurethane, polytetrafluoroethylene, high-density polyethylene, polycarbonate, polyacetal, polyethylene terephthalate, or polypropylene. Additionally or alternatively, an apparatus for facilitating angled barbell exercises may include a receiving surface having a substantially concave front side to which an abrasion-resistant coating has been applied.

In an embodiment, an apparatus for facilitating angled barbell exercises includes a receiving surface having a substantially concave front side, wherein the substantially concave front side is smooth or continuously curved across its surface. Alternatively, an apparatus for facilitating angled barbell exercises includes a receiving surface having a substantially concave front side, wherein the substantially concave front side includes a plurality of planar faces. In an embodiment, the central region of the substantially concave front side may be the area surrounding the deepest point of the concave surface. In an alternate embodiment, the central region of the substantially concave front side may be a planar face to which the rest of the concave front side funnels. In a more specific embodiment, the central region may be a planar face to which the rest of the concave front side funnels, the planar face being sized and shaped to receive a sleeve of an Olympic-sized barbell.

In an embodiment, the low end of the planar surface of the wall support may be higher than the floor support. In an embodiment, the low end of the planar surface of the wall support may be two inches higher than the floor support, three inches higher than the floor support, four inches higher than the floor support, or even five or six inches higher than the floor support. The space between the low end of the wall support and the floor may allow the apparatus to be securely positioned against a wall without contacting or interfering with a baseboard. In an embodiment, the support frame may include an intermediate portion that couples the floor support to the wall support. In a more specific embodiment, the intermediate portion may be angled relative to the planar surface of the floor support or the planar surface of the wall support, such as about 45 degrees. In an embodiment, the support frame may be a unitary body. Alternatively, the support frame may include distinct elements, such as a floor support, a wall support, and an intermediate portion, coupled together. In an embodiment, the planar surface of the floor support and the planar surface of the wall support may be coupled to a rubber pad. In an alternate embodiment, the support frame, the floor support, or the wall support may be covered in rubber. A rubber pad or coating on some or all of the support frame may prevent the apparatus from sliding while protecting the floor and wall from damage.

BRIEF DESCRIPTION OF THE DRAWINGS

The foregoing and other features of the present disclosure will become more fully apparent from the following description, taken in conjunction with the accompanying drawings. Understanding that these drawings depict only several embodiments in accordance with the disclosure and are therefore, not to be considered limiting of its scope. The disclosure will be described with additional specificity and detail through use of the accompanying drawings.

In the drawings.

DETAILED DESCRIPTION

Figure 1:
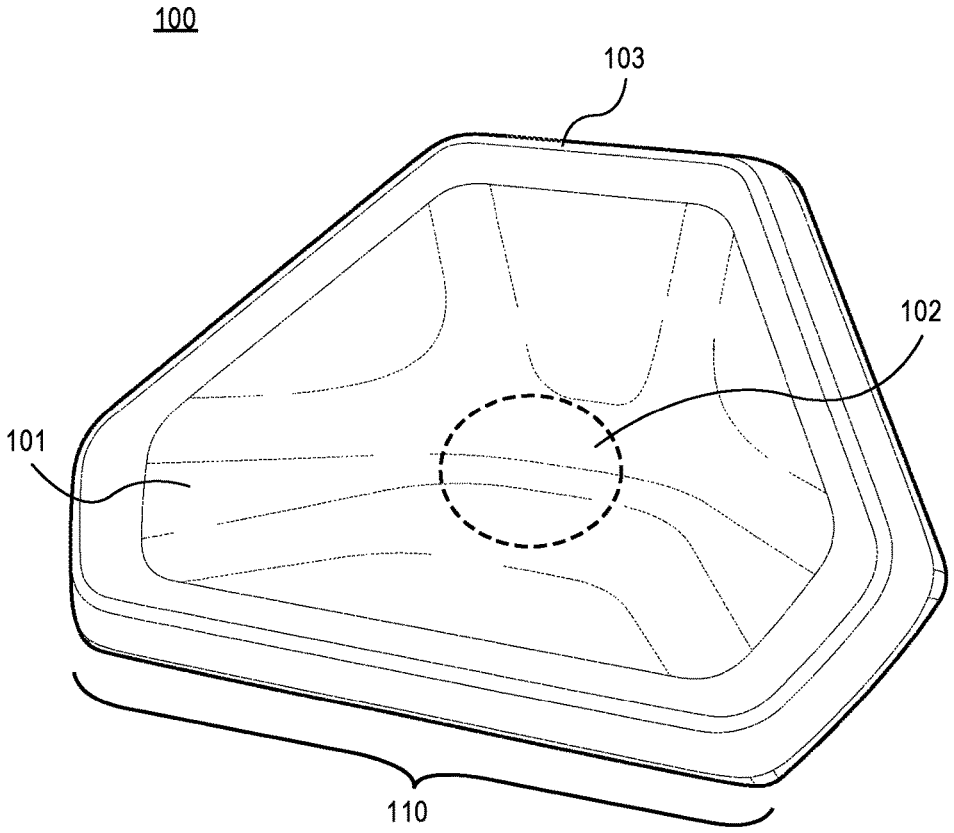
FIG. 1 depicts a front perspective view of an apparatus in accordance with an embodiment of the present disclosure.

In the following detailed description, reference is made to the accompanying drawings, which form a part hereof. In the drawings, similar symbols typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

This disclosure is directed to facilitating angled barbell exercises. An object of at least one embodiment of the present disclosure is to allow an individual, such as an individual intending to exercise at home, to perform angled barbell exercises without damaging his or her floor or wall. It is an object of another embodiment of the disclosure to quickly and easily set up a temporary station for performing angled barbell exercises, then quickly and easily return the space housing the station to its normal state. It is an object of an embodiment of the present disclosure to allow an individual to perform angled barbell exercises without bulky or heavy equipment (aside from the barbell and any weights).

FIG. 1 depicts a front perspective view of an exemplary apparatus 100 for facilitating angled barbell exercises. Apparatus 100 may include a receiving surface 110. Receiving surface 110, when in use, may receive and retain an end of a barbell. Receiving surface 110 may include a substantially concave front side 101. Substantially concave front side 101 of receiving surface 110 may include a central region 102. Apparatus 100 may have a height, a length, and a depth. Specifically, substantially concave front side 101 may have its shallowest portions around the periphery 103 of receiving surface 110 and deeper portions as substantially concave front side 101 extends from the periphery 103 to a central region 102. Central region 102 may correspond to a portion of substantially concave front side 101 that includes the deepest point. In use, the concave nature of substantially concave front side 101 may guide the end of a barbell toward the central region 102 and retain the end of the barbell in central region 102. An individual performing angled barbell exercises may still be able to pivot or rotate the barbell without worrying about the end of the barbell slipping laterally.

In an embodiment, substantially concave front side 101 of receiving surface 110 may include more than one central region 102; that is, substantially concave front side 101 may include two or more distinct deepest points. In such an embodiment, a region near the middle of substantially concave front side may rise back up from each central region 102 to a point that is approximately planar to the periphery 103. In other words, the more than one central regions 102 may be thought of as valleys or craters surrounded by higher portions of substantially concave front side 101. This embodiment may enable two or more individuals to perform angled barbell exercises simultaneously or may allow an individual to pre-load multiple barbells with different amounts of weight for different exercises. In an embodiment having a substantially concave front side 101 with more than one central region 102, the substantially concave front side may be relatively larger than a substantially concave front side 101 having only one central region 102.

In an embodiment, substantially concave front side 101 may be smooth or continuously curved across its surface. Alternatively, substantially concave front side 101 may include a plurality of faces that together form a substantially concave surface. In an embodiment, for example, substantially concave front side 101 may include a plurality of faces angled toward central region 102, which itself may be a planar face. In an embodiment, central region 102 may be sized and shaped to receive a sleeve of an Olympic-sized barbell. Alternatively, in an embodiment, substantially concave front side 101 may be smooth or continuously curved across its surface and may have a central region 102 that is also continuously curved.

Figure 2:
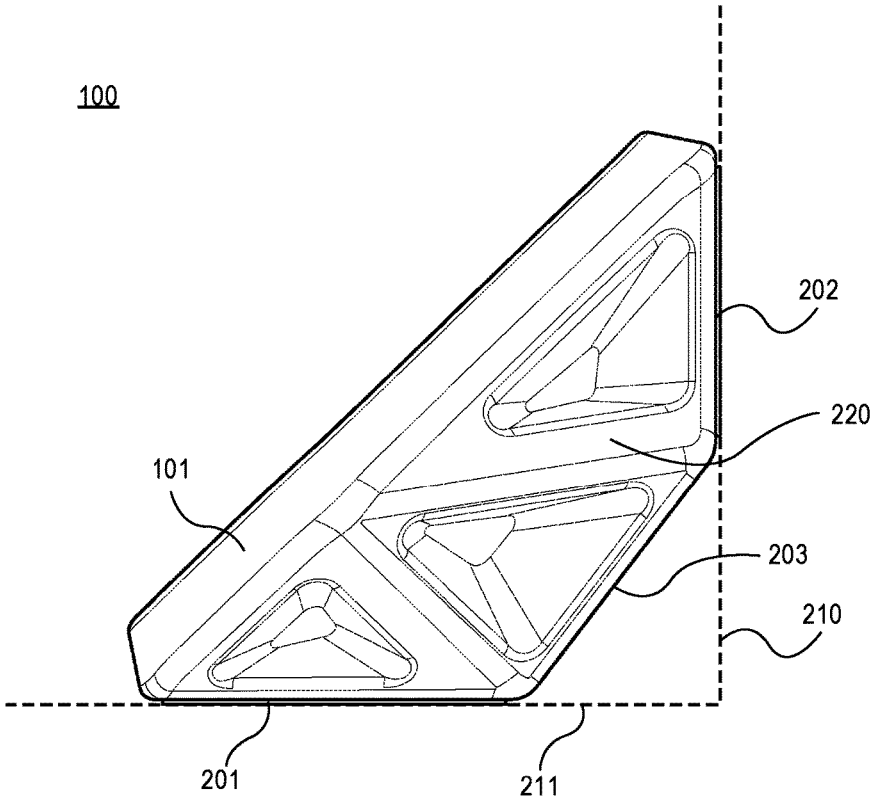
FIG. 2 depicts a side view of an apparatus in accordance with an embodiment of the present disclosure in relation to a floor and a wall.

FIG. 2 depicts a side view of an exemplary apparatus 100 for facilitating angled barbell exercises. Apparatus 100 may include a support frame 220 coupled to the back side of the receiving surface 110. Support frame 220 may include a floor support 201 and a wall support 202. Floor support 201 and wall support 202 may each include a planar surface. Floor support 201 may extend across a horizontal plane and may be positioned to contact the floor 211 on its planar surface. Wall support 202 may extend along a vertical plane substantially perpendicular to the floor 211 and may be positioned to contact the wall 210 on its planar surface. In an embodiment, the low end of wall support 202, that is, the end of wall support 202 closest to the floor 211, may be higher than floor support 201 and thus higher than the floor 211. In an embodiment, the low end of wall support 202 may be two inches or more higher than the floor support 201. In an embodiment, the low end of wall support 202 may be three inches or more higher than the floor support 201. In an embodiment, the low end of wall support 202 may be four inches or more higher than the floor support 201. In an embodiment, the low end of wall support 202 may be five inches or more higher than the floor support 201. In an embodiment, the low end of wall support 202 may be six inches or more higher than the floor support 201. In an embodiment, wall support 202 and floor support 201 are positioned such that there is no contact made with a baseboard that may extend along the bottom of wall 210.

Still with reference to FIG. 2, support frame 220 may include an intermediate portion 203 that couples the floor support 201 to the wall support 202. Intermediate portion 203 may be angled relative to the floor support 201 or wall support 202. In an embodiment, intermediate portion 203 may be angled about 45 degrees relative to the floor support 201 or wall support 202. Support frame 220 may include floor support 201, wall support 202, and intermediate portion 203 as separate pieces coupled to each other. Alternatively, support frame 220, including floor support 201 and wall support 202, may be a unitary body. In an embodiment that includes intermediate portion 203, support frame 220 may also be a unitary body.

Figure 3:
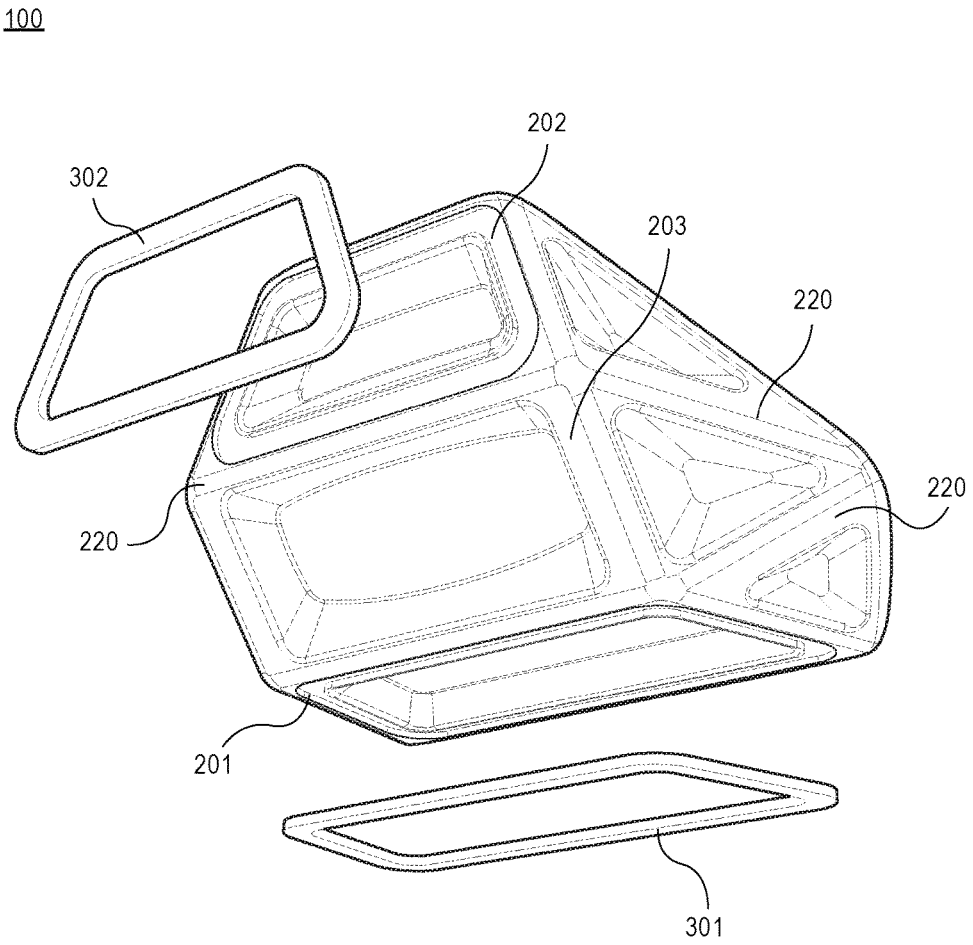
FIG. 3 depicts an exploded back perspective view of an apparatus in accordance with an embodiment of the present disclosure.

FIG. 3 depicts an exploded back perspective view of an exemplary apparatus 100 for facilitating angled barbell exercises. As described above, apparatus 100 may include a support frame 220 coupled to the back side of the receiving surface 110. Support frame 220 may include a wall support 202, floor support 201, or intermediate portion 203. One or more rubber pad(s) 302 may be coupled to wall support 202. One or more rubber pad(s) 301 may be coupled to floor support 201. Alternatively, floor support 201, wall support 202, or the entirety of support frame 220 may be covered or coated in rubber. Rubber pads 301, 302 or rubber coating on some or all of support frame 220 may prevent the apparatus 100 from sliding while protecting the floor 211 and wall 210 from damage.

Apparatus 100 may be constructed from one or more abrasion-resistant material(s). For example, an abrasion-resistant material may include one or more durable thermoplastic(s). A thermoplastic, for example, may provide an apparatus 100 that is relatively lightweight, increasing its portability, while still being resistant from wear from a pivoting or rotating barbell. In an embodiment, apparatus 100 may be constructed or formed from nylon, polyurethane, polytetrafluoroethylene, high-density polyethylene, polycarbonate, polyacetal, polyethylene terephthalate, or polypropylene. Additionally or alternatively, an apparatus for facilitating angled barbell exercises may include a receiving surface having a substantially concave front side to which an abrasion-resistant coating has been applied.

Figure 4A:
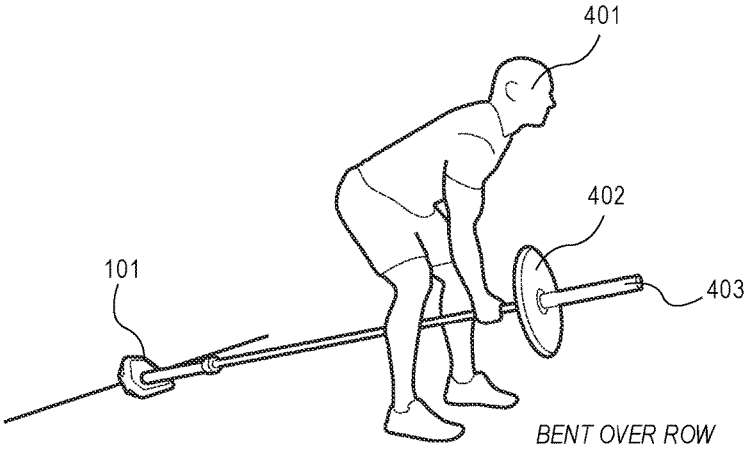
FIG. 4A depicts an individual performing a first exercise using an apparatus in accordance with an embodiment of the present disclosure.

FIG. 4A depicts an individual 401 performing a first angled barbell exercise using a barbell 403 with a weight plate 402. In the figure, one end of barbell 403 is placed in the substantially concave front side 101 of a receiving surface 110 of an apparatus 100.

Figure 4B:
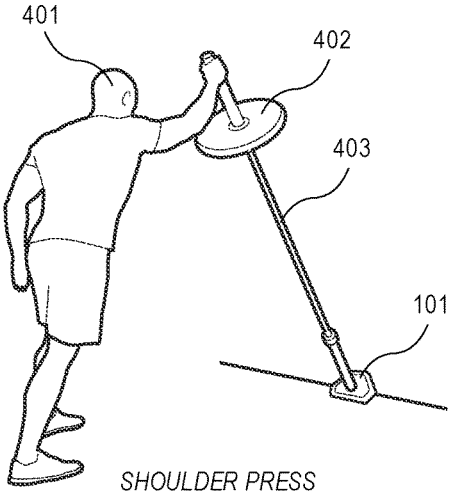
FIG. 4B depicts an individual performing a second exercise using an apparatus in accordance with an embodiment of the present disclosure.

FIG. 4B depicts an individual 401 performing a second angled barbell exercise using a barbell 403 with a weight plate 402. One end of barbell 403 is placed in the substantially concave front side 101 of a receiving surface 110 of an apparatus 100.

Figure 4C:
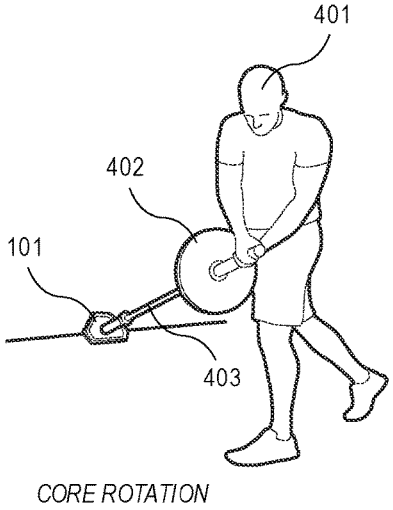
FIG. 4C depicts an individual performing a third exercise using an apparatus in accordance with an embodiment of the present disclosure.

FIG. 4C depicts an individual 401 performing a third angled barbell exercise using a barbell 403 with a weight plate 402. One end of barbell 403 is placed in the substantially concave front side 101 of a receiving surface 110 of an apparatus 100. The exemplary angled barbell exercises shown in FIGS. 4A, 4B, and 4C illustrate how a barbell may pivot or rotate while still being retained by substantially concave front side 101 of the receiving surface 110.

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. An apparatus for facilitating angled barbell exercises, comprising:

a receiving surface having a substantially concave front side including a central region defined by the peripheral walls of the concavity, wherein the deeper portion of the central region of the concavity provides guidance and retention for the bar end of a barbell;

a back side; and a support frame coupled to the back side and including a floor support having a planar surface and a wall support having a planar surface, wherein the planar surface of the floor support is horizontal and positioned to contact a floor; and wherein the planar surface of the wall support is vertical and positioned to contact a wall that is perpendicular to the floor.

2. The apparatus of claim 1, wherein the substantially concave front side of the receiving surface is smooth.

3. The apparatus of claim 1, wherein the substantially concave front side of the receiving surface includes a plurality of planar faces.

4. The apparatus of claim 3, wherein the substantially concave front side of the receiving surface includes at least five planar faces.

5. The apparatus of claim 1, wherein the low end of the wall support is at least three inches higher than the floor support.

6. The apparatus of claim 5, wherein the support frame includes an intermediate portion that couples the floor support to the wall support.

7. The apparatus of claim 6, wherein the support frame is a unitary body.

8. The apparatus of claim 1, further comprising a rubber pad coupled to each of the planar surface of the floor support and the planar surface of the wall support.

9. The apparatus of claim 1, further comprising a rubber coating coupled to the exterior of the support frame.

10. The apparatus of claim 1, wherein the substantially concave front side of the receiving surface includes an abrasion-resistant material selected from the group consisting of:

nylon;

polyurethane;

polytetrafluoroethylene;

high-density polyethylene;

polycarbonate;

polyacetal;

polyethylene terephthalate; and polypropylene.

11. The apparatus of claim 10, wherein the abrasion-resistant material is an abrasion-resistant coating.

12. An apparatus for facilitating angled barbell exercises, comprising:

a receiving surface having a substantially concave front side including a plurality of central regions defined by the peripheral walls of the concavity, wherein each central region has a deeper portion that provides guidance and retention for the bar end of a barbell;

a back side; and a support frame coupled to the back side, the support frame including a floor support having a planar surface and a wall support having a planar surface, wherein the planar surface of the floor support is horizontal and positioned to contact a floor;

wherein the planar surface of the wall support is vertical and positioned to contact a wall that is perpendicular to the floor; and wherein the substantially concave front side includes a raised region extending from near the top of the periphery to near the bottom of the periphery, the raised region having a third depth approximately equal to the first depth.

* * * * *